US011173581B2

(12) United States Patent
Buchanan

(10) Patent No.: US 11,173,581 B2
(45) Date of Patent: Nov. 16, 2021

(54) DUAL JAW ADJUSTABLE WRENCHES

(71) Applicant: Nigel Buchanan, New Gilston by Leven Fife (GB)

(72) Inventor: Nigel Buchanan, New Gilston by Leven Fife (GB)

( * ) Notice: Subject to any disclaimer, the term of this patent is extended or adjusted under 35 U.S.C. 154(b) by 192 days.

(21) Appl. No.: 16/333,013

(22) PCT Filed: Sep. 13, 2017

(86) PCT No.: PCT/GB2017/052705

§ 371 (c)(1),
(2) Date: Mar. 13, 2019

(87) PCT Pub. No.: WO2018/051090

PCT Pub. Date: Mar. 22, 2018

(65) Prior Publication Data

US 2019/0262976 A1 Aug. 29, 2019

(30) Foreign Application Priority Data

Sep. 13, 2016 (GB) ..... 1615568

(51) Int. Cl.
*B25B 13/14* (2006.01)

(52) U.S. Cl.
CPC ..... *B25B 13/14* (2013.01)

(58) Field of Classification Search
CPC ..... B25B 13/10; B25B 13/12; B25B 13/14; B25B 13/16; B25B 13/46
See application file for complete search history.

(56) References Cited

U.S. PATENT DOCUMENTS

| | | | | |
|---|---|---|---|---|
| 5,209,144 | A | 5/1993 | Lu | |
| 5,305,667 | A | 4/1994 | Caballero | |
| 6,089,129 | A * | 7/2000 | Huang | B25B 13/46 81/133 |
| 7,077,035 | B1 | 7/2006 | Huang | |
| 2009/0193939 | A1 | 8/2009 | Chiu et al. | |
| 2011/0023665 | A1* | 2/2011 | Huang | B25B 13/46 81/165 |
| 2012/0247281 | A1 | 10/2012 | Foltyn | |
| 2015/0190906 | A1 | 7/2015 | Huang | |
| 2015/0266167 | A1* | 9/2015 | Robinson | B25B 13/46 81/60 |
| 2016/0082575 | A1* | 3/2016 | Yu | B25B 13/46 81/58.2 |

FOREIGN PATENT DOCUMENTS

| | | | |
|---|---|---|---|
| CN | 101376235 | A | 3/2009 |
| EP | 0464016 | B1 | 1/1992 |
| GN | 2150974 | Y | 12/1993 |
| GN | 2196532 | Y | 5/1995 |
| GN | 2360221 | Y | 1/2020 |

* cited by examiner

*Primary Examiner* — David B. Thomas
(74) *Attorney, Agent, or Firm* — Will Hunziker

(57) ABSTRACT

An adjustable wrench has a wrench head provided with a fixed jaw, a movable jaw carried by the wrench head, a first movable jaw actuator mounted on the wrench head and a second movable jaw actuator mounted on said wrench head. The movable jaw is provided with teeth engagable by the first and second movable jaw actuators and the first movable jaw actuator is movable to an inoperative position to enable actuation of the movable jaw by the second movable jaw actuator.

17 Claims, 12 Drawing Sheets

US 2012/024 7281 A1

DUAL JAW ADJUSTABLE WRENCHES

FIELD OF INVENTION

The invention relates to hand tools and in particular to adjustable wrenches.

BACKGROUND TO THE INVENTION

A conventional wrench is a tool used to provide grip and mechanical advantage in applying torque to turn objects, usually rotary fasteners, such as nuts and bolts. Alternatively, wrenches may be used to keep such objects from turning. One type of wrench is called an open-end wrench, which usually has a U-shaped opening shaped to grip two opposite faces a polygonal fastener. As torque is applied to the wrench head it is transmitted to the fastener to turn the fastener in the appropriate direction.

Sockets or ring type wrenches are preferable to open jaw type wrenches because the torque applied to the socket is transmitted to the fastener via a much larger contact area and the ring head of the socket or wrench can transmit a far greater torque with less harmful distortion of the fastener and less chance of the socket or ring head damaging or slipping off the fastener. In order to fit and operate as many differing sizes of fasteners as possible with one tool the wrench can usefully be adjustable, by far the most common type relates to an adjustable wrench such as Huang TW app. No. 201527051 comprising a handle, a head, a slidable jaw, an axial rod and a worm gear. The head is formed with a fixed jaw, a sliding rail, and a receiving slot. The slideable jaw has a sliding rod slidable disposed in the sliding rail of the head. The axial rod and the worm gear dispose in the receiving slot of the head and the worm gear engages with the sliding rod of the slidable jaw to control the movement of the slidable jaw in relation to the fixed jaw so that an opening formed between the fixed and slidable jaw can be usefully adjusted for the operation of different sizes of fastener head whether metric or inch. The wrench normally grips only on the two opposing sides of the square or hexagonal fastener heads or workpiece.

In order to provide grip on more sides of hexagonal fasteners by the opposing jaws of the wrench, some prior art wrenches such as Pub. No. US20090193939 have been provided that have V shaped gripping surfaces. As only the leading half of the hexagonal fastener head faces in the operated direction can be actually levered in the chosen drive direction the "V" shape recess must be deep enough to provide a suitable fastener drive engagement surface thus extremely limiting the size range of operated fasteners capable of being suitably operated. US pat. App. 2012247281 comprises an adjustable wrench for use with speciality fasteners with 3 flat faces and 3 round faces having a fixed jaw with a V recess and a flat third gripping surface which is slidable when operated in the reverse or reposition direction, in order to form a ratcheting configuration. Hexagonal fasteners can be 3 face operated as long as the operated hexagonal fastener head still protrudes outwith the V recess for clamping by the moving jaw third flat face. In order to operate smaller sizes of fastener the nose of the fixed jaw is substantially parallel to the moving jaw face, the fastener can then be operated by only 2 faces.

U.S. Pat. No. 5,209,144 Lu illustrates a dual purpose wrench wherein the moving jaw can be alternated to function as a pipe wrench by removing the moveable jaw unit, reversing and inserting it back into the wrench body. What was previously the lower outer surface of the moving jaw now acts as a pivotal straight toothed surface, which in conjunction with the fixed jaw operating surface grips the worked pipe or round workpiece in order to rotate the same.

U.S. Pat. No. 5,209,144 Lu, EP0464016 Jansson, Conny and U.S. Pat. No. 5,209,144 denote a combination tool in the form of an "monkey wrench" or pipe wrench with a reversible jaw, the commercially successful device being the EP0464016, these devices when used in the pipe wrench mode require to be used in the non-intuitive opposite direction to that of the adjustable wrench normal torque use, even the pipe engagement teeth facing the reverse direction.

With these known wrenches it requires considerable rotation of the thumb operated worm screw to adjust from small to large operating sizes or remove and replace the moving jaw. Furthermore any attempt at making a useful three or four jaw grip upon the operated fastener cannot be accomplished over the fastener size range normally operated by a similar sized standard adjustable wrench.

It is an object of the invention to at least partially alleviate the above mentioned disadvantages, or to provide an alternative to existing products.

SUMMARY OF THE INVENTION

The invention provides an adjustable wrench as specified in claim 1.

The invention also includes a method of operating an adjustable wrench as specified in claim 15.

The invention also includes an adjustable wrench comprising a wrench head having a fixed jaw and a movable jaw mounted on said wrench head, wherein said fixed and movable jaws define at least three gripping faces orientated such that, in use, when a drive torque is applied to said wrench head said gripping faces each transmit said torque to a respective face of a hexagonal workpiece engaged by said gripping faces.

Examples of the adjustable wrench may provide a low-cost tool that can be speedily adjusted, work on a relatively large range of normal fastener heads, pipe or pipe fitting sizes. The jaws of the adjustable wrench may define at least three gripping faces so that three faces of a workpiece can be engaged to provide an improved gripping capability when compared with wrenches that engage just two faces of the workpiece. Thus, embodiments of the adjustable wrench may provide a true three jaw grip that engages first, second and third faces of a hexagonal fastener that are each orientated to receive a drive torque.

The moveable jaw may be removed from the wrench head to allow reversing of its orientation and reinsertion to allow the provision of additional gripping faces on the movable jaw. At least one gripping surface may now be a toothed surface which forms a toothed ramp whereby when the wrench is operated in its drive direction upon a generally tubular workpiece initially positioned and gripped between the appropriately adjusted fixed and moveable jaw gripping surfaces. The tubular workpiece when operated may be retained within a V shaped recess, the opposing jaw surface comprising a toothed ramp or a further corresponding V shaped recess, at least one gripping surface being appropriately toothed.

In use, the operator robustly biases the wrench handle side-wards causing the outer edges of the wrench head gripping teeth to usefully impart substantial grip upon the worked cylindrical workpiece as the wrench is operated in the drive direction, when the wrench requires to be repositioned or reversed the operator merely straightens the handle back up negating the jaws grip upon the workpiece thereby imparting an extremely useful and simple ratcheting feature with no moving parts.

Examples of the adjustable wrench may use a worm gear having a longitudinally extending cut-out similar in shape but slightly oversized compared to rack teeth of the movable jaw. When the worm drive is turned to a position wherein the cut-out faces the rack teeth, the movable jaw can be moved independently of the head portion for quick adjustment of the distance between the first and second workpiece faces. A known screw incorporating a sprung ball plunger, or similar can be further utilized in co-operation with a suitable notch within the worm drive in order to retain the worm drive in the disengaged position. Once the close approximate jaw setting is made the worm drive may be further rotated to re-engage the rack gear teeth so that the worm gear can be used to cause movement of the movable jaw relative to the fixed jaw and further providing the known locking mechanism between the worm drive and the rack teeth.

In order to speed up the adjustment procedure a thumb wheel, may be used to move the movable jaw. The teeth of the thumbwheel engage the rack teeth and when the worm drive is positioned with the cut-out facing the rack teeth, the thumbwheel can be rotated in order to move the movable jaw speedily in order to quickly adjust the space between the fixed and movable jaws. The use of the thumbwheel when removing the movable jaw when turning it over and inserting back in order to convert the adjustable wrench between a parallel faced hexagonal or flat drive surfaced workpiece and generally round workpiece moving jaw engagement surfaces is particularly useful.

Examples of the adjustable wrench may have a means of locating the movable jaw in the required position, wherein the worm gear teeth can readily engage the moving jaw geared rack teeth from a disengaged position to an engaged position. In one example the moving jaw has indentations or recesses for the location of the ball of a known sprung ball plunger or equivalent located within the head portion, the use of an indentation correctly positioned relative to each relevant geared rack tooth provides a useful means of conveniently indexing the moving jaw from one exact pre-locking position to another, the sprung ball further usefully retaining the moving jaw within the head portion whenever the worm gear cut out is aligned with the moving jaw gear rack. The sprung ball being further propelled against its corresponding spring during the relocation of the moving jaw relative to the fixed jaw.

A further low cost method of correctly positioning the worm gear cut out prior to its engagement with the geared rack teeth, is the use of a sprung steel blade retained within the worm gear aperture, having an engagement portion for the resilient contact with the geared rack teeth prior to the re-engagement of the worm gear teeth into the geared rack teeth during the final adjustment process. The engagement portion being capable of usefully flexing out of contact in order to allow the moving jaw to be robustly propelled as required inwards or outwards within the moving jaw receiving slot during the fast adjustment action.

This example can further be a useful complement to a standard adjustable wrench not just a dual purpose wrench.

In some examples the adjustable wrench has second and third fixed jaw operating faces formed in a 60 deg. V. In order to prevent the worked fastener from moving from the confines of the second and third fixed jaw operating faces during hexagonal fastener operation, the moving jaw has a small fourth face or proboscis which along with the first operating face within the moving jaw form an opposite 60 deg. V face capable of robust three levered face operation of the worked fastener.

Examples of the adjustable wrench may provide a wrench comprising a head portion and a handle portion. The head portion comprises in one example of a fixed jaw having a smooth or alternately toothed flat plane surface generally 90 degrees to the sliding rail faces. The moving jaw having a generally V shaped recess having gripping teeth angled in the preordained drive direction, for the rotation of tube like workpieces when the said profile is employed and appropriately adjusted.

In use, in order to employ a further simple ratcheting motion upon the surface of the worked pipework or tube like workpiece, the wrench is near adjusted to the circumferential size upon the pipe, in order to initiate the required grip the wrench handle is then biased in a side-wards direction whereas the outer angled toothed profiles of the utilized V shaped recess or recesses grip the surface of the pipe in order to rotate the said pipe in the drive direction. When utilized in the reverse or reposition direction the handle is usefully returned to a non-biased generally right angled position relative to the worked pipe whereas the inclined gripping teeth are now profiled in a non-gripping position or direction and the wrench can be usefully repositioned with ease.

In some examples, a moving jaw angled toothed operating surface may be replaced with a hard rubber like gripping surface for use upon soft or decorative fittings or pipework surfaces in order to prevent or at least diminish the marking of the same. The further use of a clip on plastic or non-mark material guard on the opposing gripping surface further diminishes the possibility of damage.

BRIEF DESCRIPTION OF THE DRAWINGS

A full and enabling disclosure of the invention will now be provided by way of a description of some examples and with reference to the drawings, in which.

DETAILED DESCRIPTION

Figure 1:
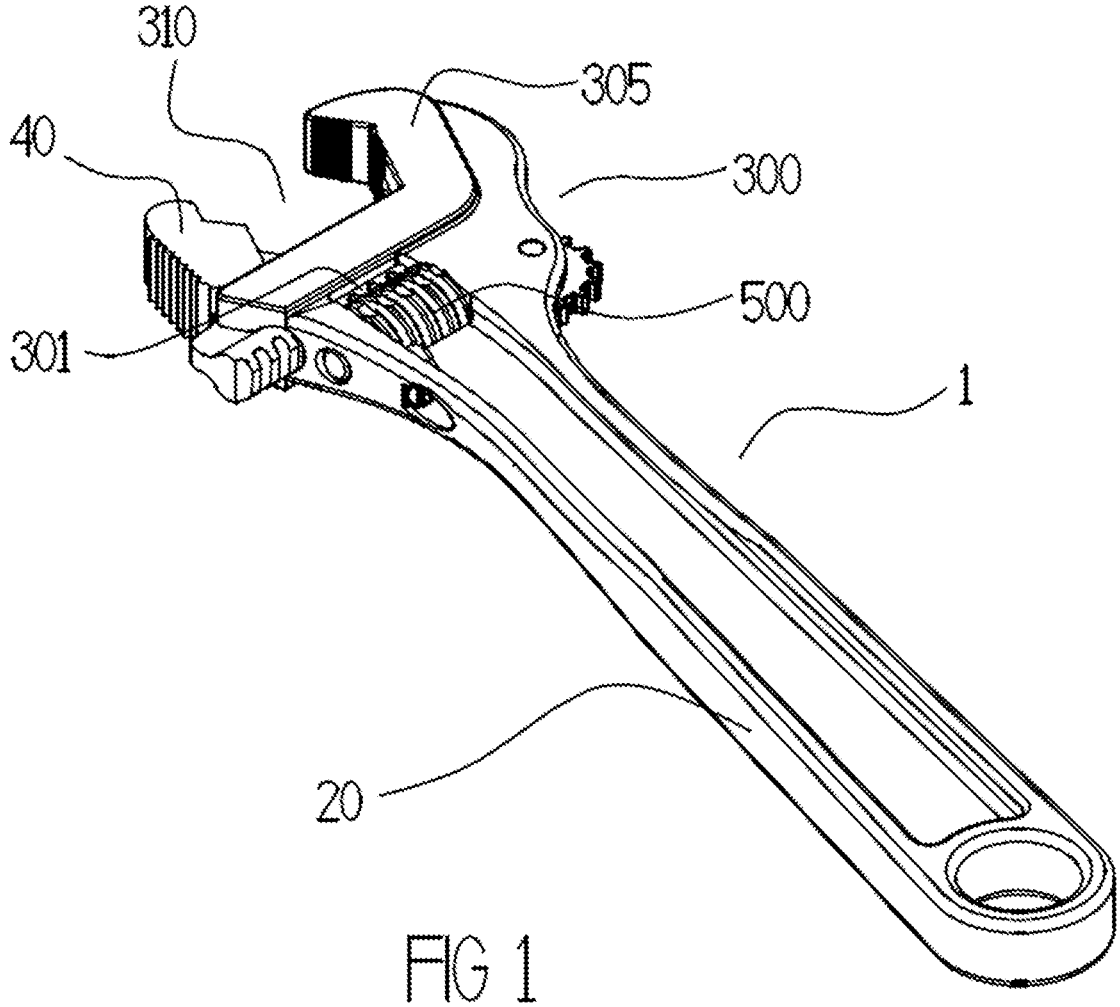
FIG. 1 is a perspective view of an adjustable wrench.

FIG. 1 shows an adjustable wrench 1 having a head portion 300 at one end of an elongate handle portion 20. The saidhead portion 300 comprises a fixed jaw 305, a movable jaw 40 and a first movable jaw actuatorcomprising a worm drive 500 disposed in a worm drive aperture 301. The first movable jaw actuator is operable to cause movement of the movable jaw 40 to adjust the width of a jaw opening 310 that is defined between the fixed and movable jaws.

Figure 2:
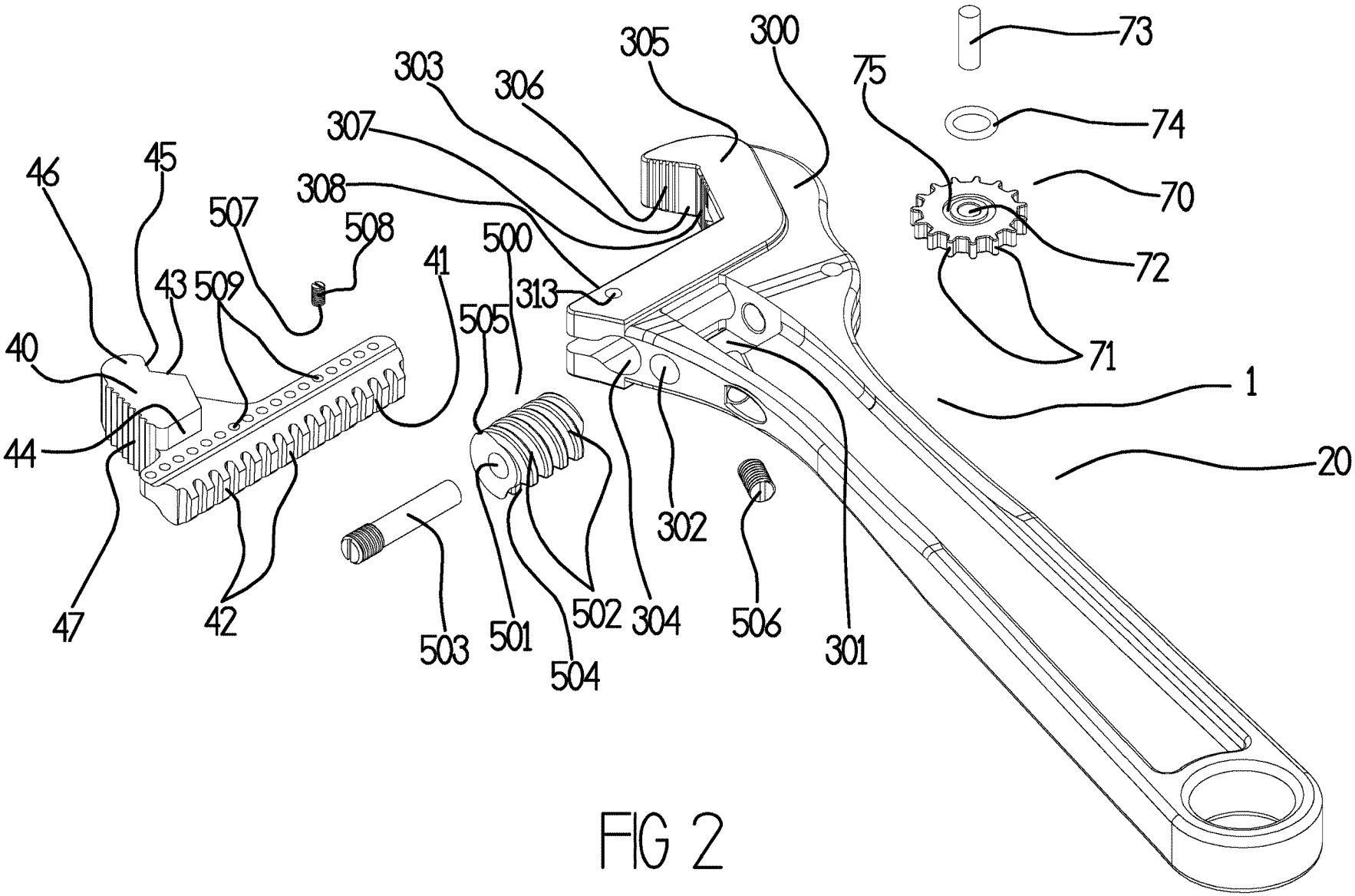
FIG. 2 is an exploded perspective view of the adjustable wrench of FIG. 1.
Figure 3:
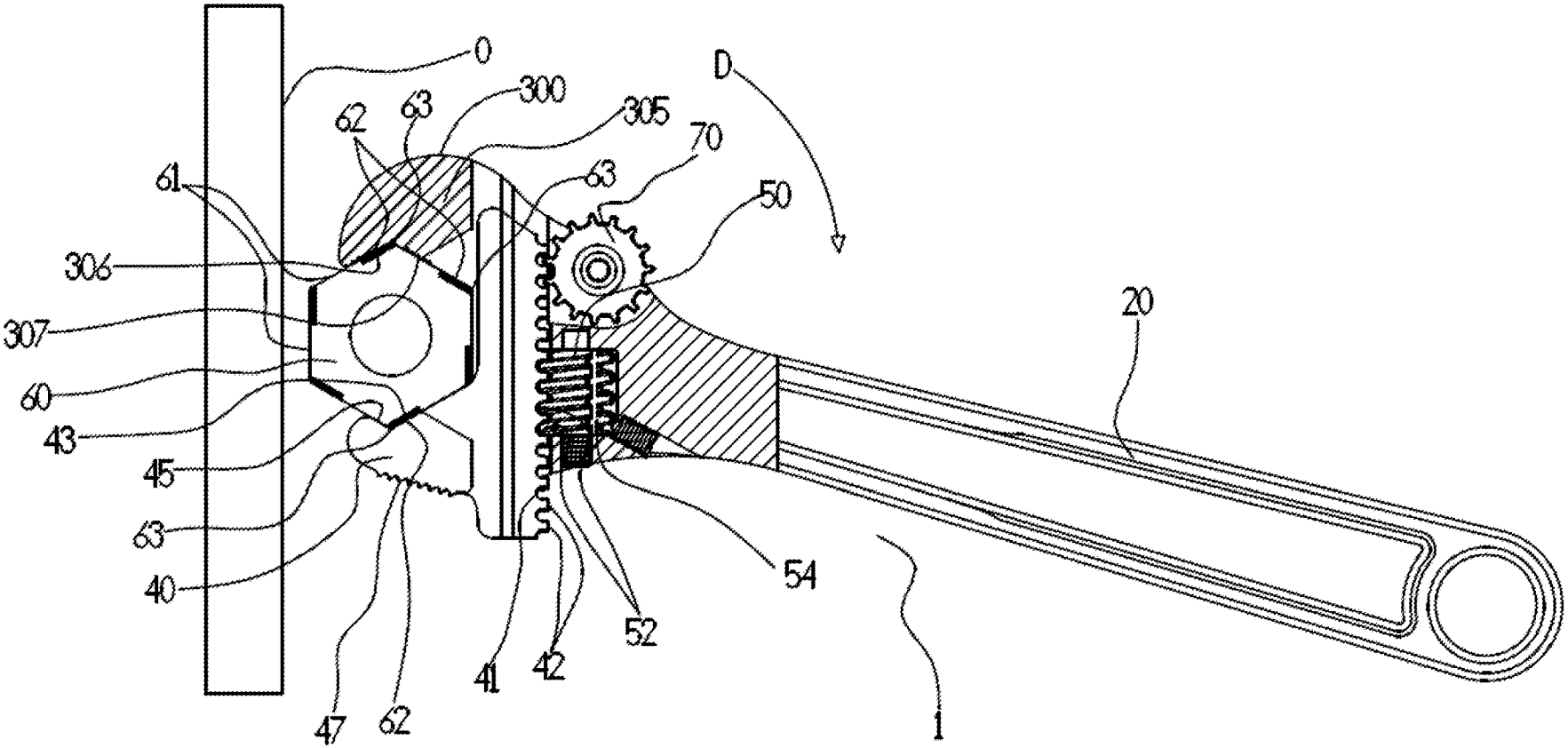
FIG. 3 is a partially section plan view of the adjustable wrench of FIG. 1 shown gripping a hexagonal fastener.

FIG. 2 shows the components of the adjustable wrench 1 in a disassembled condition. The components of the adjustable wrench 1 include the handle portion 20, the head portion 300, the worm gear aperture 301 and an axle pin bore 302. A V shaped recess 303 is defined in the fixed jaw 305 and the head portion 300 defines a moving jaw receiving slot 304. The moving jaw receiving slot 304 extends transverse to the handle portion 20. As best seen in FIG. 3, the moving jaw slot 304 may be inclined with respect to the handle portion 20 and may extend between opposed sides of the head portion 300 so as to be open at each end. The movable jaw 40 may define a first operating face 43 and the fixed jaw 305 may define a second operating face 306 and a third operating face 307. The head portion 300 defines a sliding rail first face 308 and the movable jaw 40 defines a jaw alignment face 45. There may be respective sliding rail first faces disposed one on either side of the moving jaw receiving slot 304 and respective jaw alignment faces 45. The movable jaw 40 has a nose 46. The movable jaw 40 is provided a rack 41 comprising rack teeth 42, The movable jaw 40 may define a fourth gripping face 47 of the adjustable wrench 1.

The worm drive 500 comprises a generally cylindrical body having a worm axle bore 501 extending along the longitudinal axis of the body and toothing 502 winding around the body. The worm drive 500 is mounted in the worm gear aperture 301 on a worm axle 503 that extends through the axle pin bore so that the worm axle bore defines an axis of rotation of the first movable jaw actuator that is coincident with the longitudinal axis of the body. The worm drive 500 is provide with a worm cut out 504 that defines a gap in the toothing 502. The worm drive cut-out 504 extends along the length of the worm drive body.

The first movable jaw actuator is provided with a first movable jaw actuator locator configured to engage a locator formation provided on said first movable jaw actuator to locate the worm drive body in a position in which the worm cut out 504 faces the rack teeth 42. The locator formation comprises a worm detent profile 505 and the first movable jaw actuator locator comprises a sprung ball plunger 506.

The head portion 300 further comprises a second movable jaw actuator comprising a thumbwheel 70. The thumbwheel 70 comprises a disc-like body provided with thumbwheel teeth 71, a thumbwheel axle bore 72 to receive an axle pin 73 and a friction ring to receive a friction ring 74. The thumbwheel teeth 71 are disposed around the periphery of the disc-like body and projection radially outwardly with respect to the thumbwheel axle bore 72. As best seen in FIG. 3, the thumbwheel 70 is mounted in a recess disposed to one side of the head portion 300. The worm drive 500 and thumbwheel 70 are arranged such that their respective axes of rotation are mutually perpendicular while the axis of rotation of the worm drive extends generally parallel to the moving jaw slot 304.

The adjustable wrench 1 further comprises a movable jaw movement resistor in the form of a detent mechanism comprising a moving jaw sprung plunger 508, sprung ball 507 located in the plunger and a plurality of detent recess 509 provided on the movable jaw 40. The moving jaw sprung plunger 508 is mounted in a screw hole 313 provided in the head portion 300

FIG. 3 shows the adjustable wrench 1 with a part of the handle portion 20 and the head portion 300 sectioned in order to illustrate the arrangement of the movable jaw 40 and first and second movable jaw actuators on the head portion 300. The toothing 502 of the worm drive 500 is shown engaging rack teeth 42, while the worm drive cut-out 504 is in an inoperative position. For illustration purposes the first, second and third operating faces 43, 306, 307 are shown engaging a large hexagonal fastener 60. The alignment face 45 within the movable jaw 40 keeps the fastener 60 in the optimum position whereas the fastener driven faces 62 can be usefully engaged when operated in the drive direction D in order to robustly operate as required the said fastener 60. As only the half of the said fastener face 61, that which is in the chosen drive direction D, the said driven faces 62 actually does any rotational leverage, only that said portion 62 need be operated by the said fixed or moving jaws 305, 40. One example of the optional said fourth gripping face 47 is further illustrated within the said moving jaw 40. By only acting upon the actual half of the fastener faces 61 which are driven 62, this thereby usefully reduces the overall projected length of the said jaws 305, 40 vastly improving the wrenches use in situations wherein the said fastener 60 is adjacent to obstructions O. In particular said hexagonal fasteners 60 are operated in their chosen said drive direction D normally by only half the span (that which is in the driven direction D) of the relevant gripped generally flat operating surfaces 61 of the said driven portions 62, the said fastener 60 said fastener driven faces illustrated being usefully fully engaged by all three operating faces 43, 306 and 307 of the said wrench 1. It is noted that the leverage of the said driven portions 62 is at its greatest the nearer to the fastener points 63 the said operating face 43, 306 or 307 applied force is employed.

Figure 4:
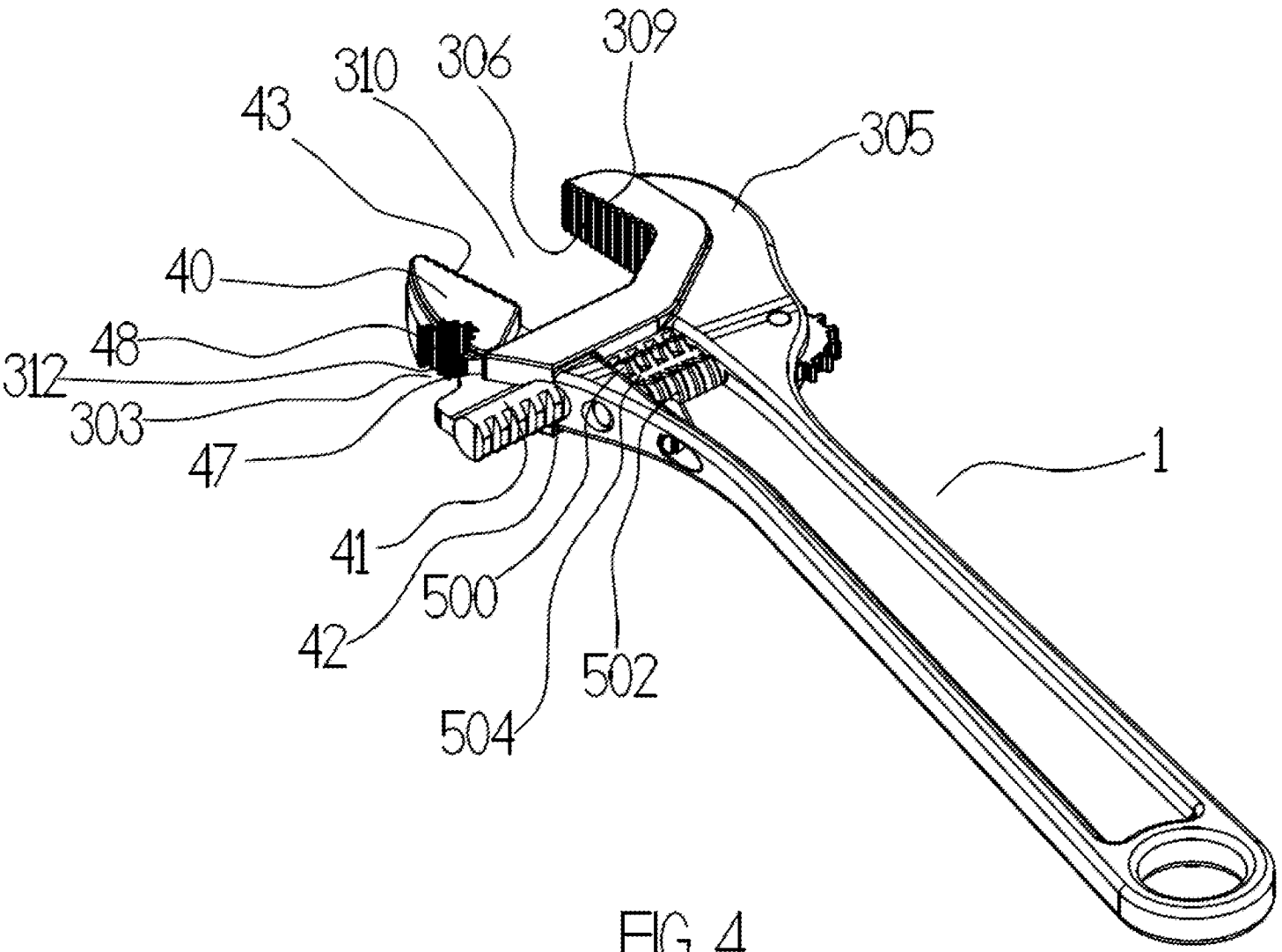
FIG. 4 is a perspective view showing a modification of the adjustable wrench of FIG. 1.

FIG. 4 illustrates a modification of the adjustable wrench 1 in which the second operating face 306 defined by the fixed jaw is substantially straight and the first operating face 43 defined by the movable jaw 40 is also straight so that the sides of the jaw opening 310 are generally parallel. The first and second jaw operating faces 43, 306 may be notched 309 to improve their ability to grip objects. As an aid to gripping some types of workpieces, the movable jaw 40 may comprise a V-shaped recess 303 said that defines fourth and fifth gripping surfaces 47, 48. In this example, the fourth and fifth gripping surfaces are provided with teeth 312. The toothing 502 of the worm drive 500 is shown engaging the rack teeth 42, while the the worm drive cut-out 504 is shown in an inoperative position.

Figure 5:
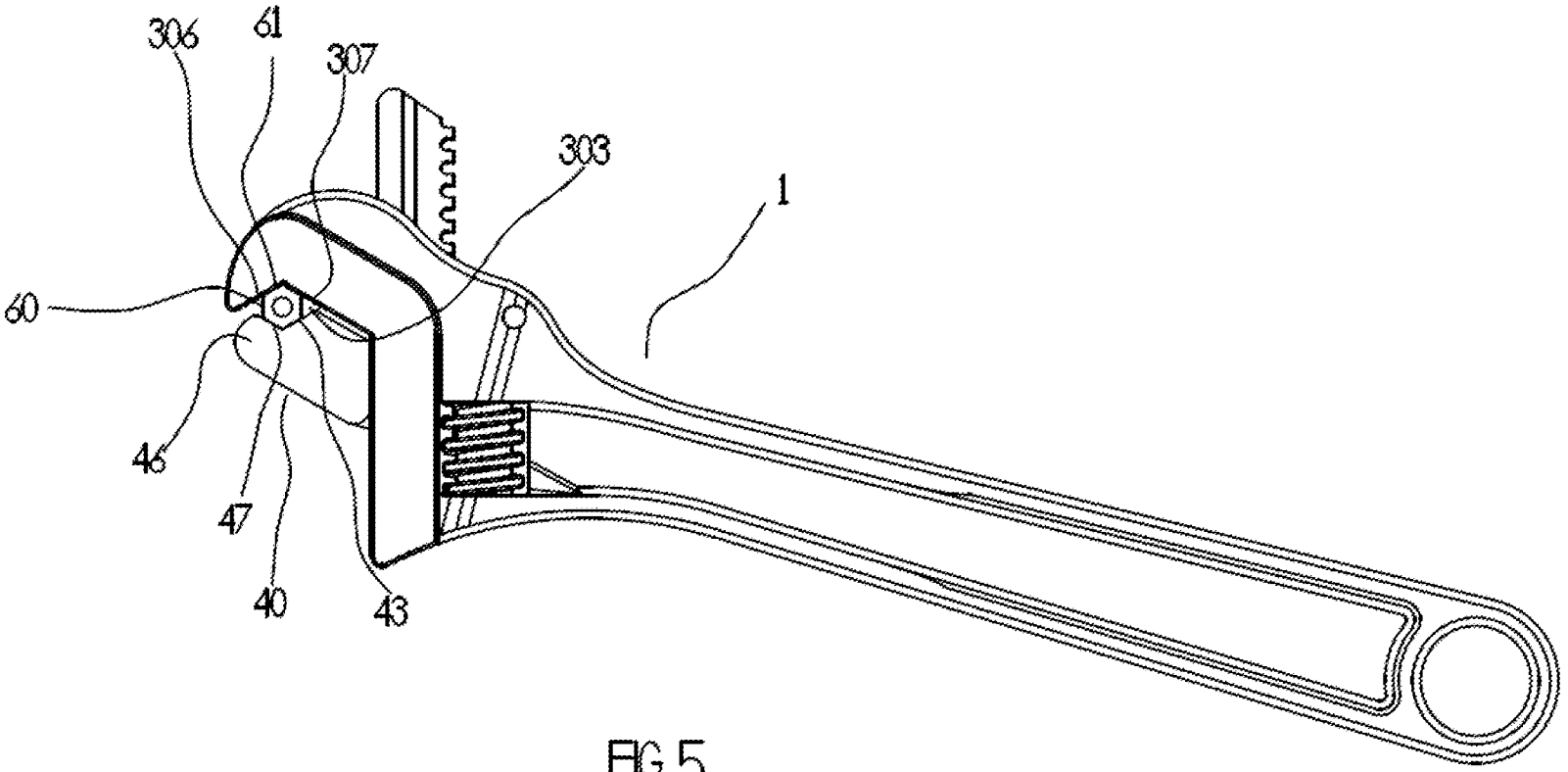
FIG. 5 shows another adjustable wrench shown gripping a small hexagonal fastener.

FIG. 5 ishows the adjustable wrench 1 with the the said first, second, third and fourth operating faces 43, 47, 306 and 307 engaging a relative small hexagonal fastener 60. To facilitate gripping of smaller sizes of fastener the nose 46 of the movable jaw 40 may be configured to be movable into the V-shaped recess 303 defined by the fixed jaw 300 Although not shown in the drawing, the adjustable wrench 1 may have first and second movable jaw actuators as shown in FIGS. 1 to 4.

Figure 6:
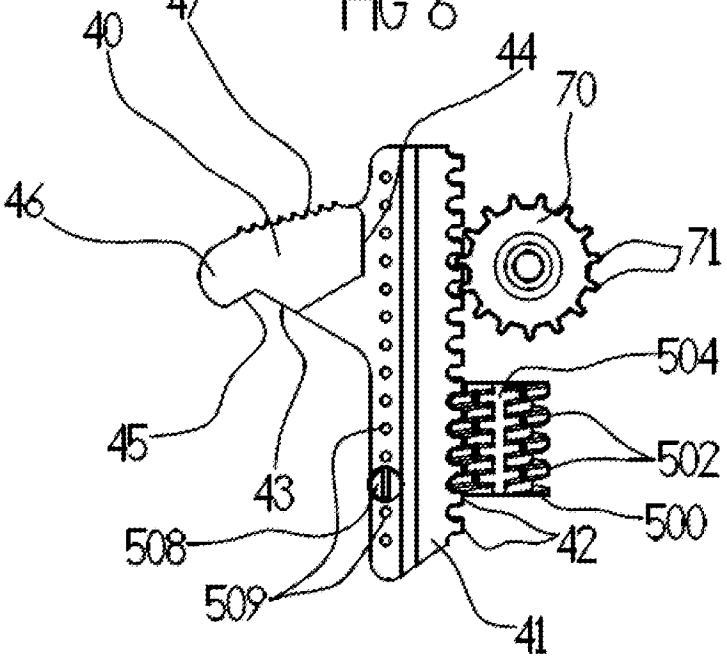
FIG. 6 is a plan view of components of the adjustable wrench of FIG. 1 showing a first movable jaw actuator in an operative condition.
Figure 7:
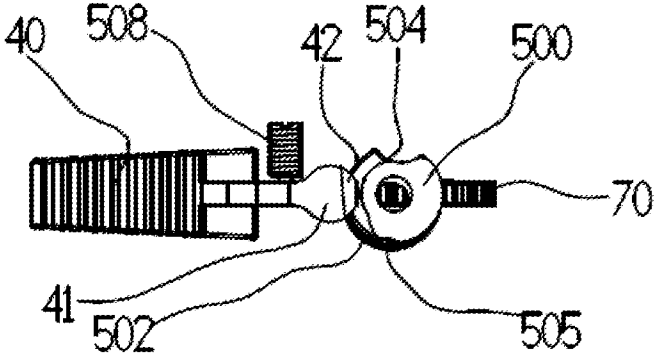
FIG. 7 is a side view of the components shown in FIG. 6.

FIGS. 6 and 7 show the movable jaw 40, said worm gear drive 500 and thumbwheel 70 removed from the wrench land with the worm drive cut-out 504 in an inoperative position similar to that shown in FIGS. 1, 3 and 4. The worm drive toothing teeth 502 is shown engaged with the rack teeth 42 and the worm drive cut-out 504 is not facing the rack teeth. The thumbwheel teeth 71 are also engaged with the rack teeth 42.

Figure 8:
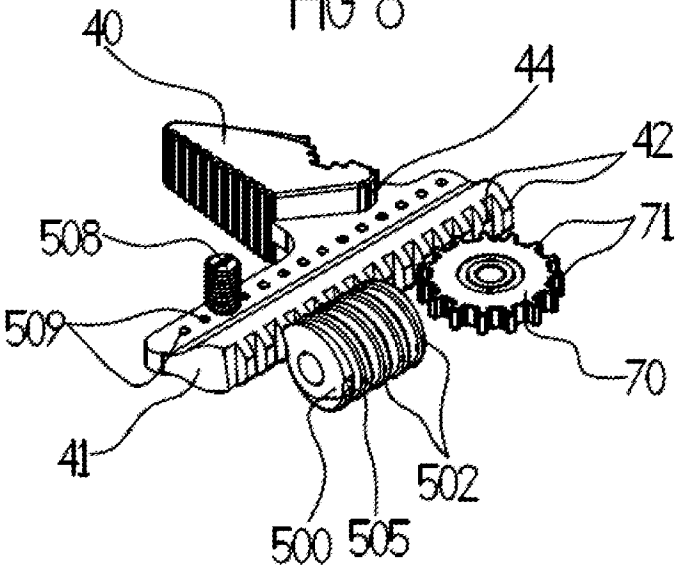
FIG. 8 is a perspective view of the components shown in FIG. 6 with the first movable jaw actuator in an inoperative condition.
Figure 9:
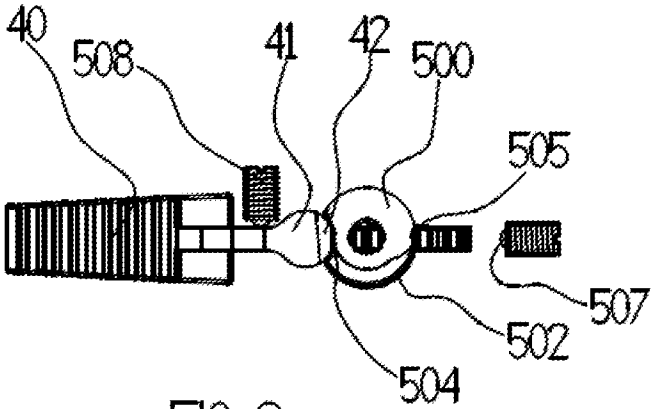
FIG. 9 is a side view of the components shown in FIG. 8.

FIGS. 8 and 9 correspond generally to FIGS. 6 and 7, but show the worm drive cut-out 504 in a position in which it faces the rack teeth 42 so that the worm drive toothing 502 does not engage the rack teeth. This allows the movable jaw 40 to be propelled back and forth by operation of the thumbwheel 70 in order to open or close the jaw gap 310 (not shown) or remove or install the said movable jaw 40 relatively quickly. The resiliently biased engagement of the sprung ball 507 of the sprung ball plunger in the moving jaw detents 509 impedes the traversing of the movable jaw 40 during the adjustment of the jaw opening 310 prior to the engagement of the worm drive toothing 502 with the rack teeth 42. As the said movable jaw 40 moves back and forth, the sprung ball 507 pops in and out of the moving jaw detents 509 slightly impeding movement of the movable jaw 40 and so reducing the likelihood of inadvertent removal of the movable jaw from the head portion 300. The moving jaw detents 509 are configured to such that when engaged by the sprung ball 507 the toothing 502 is aligned with the rack teeth 42 to ensure the correct and easy alignment of the toothing 502 with the rack teeth 42 for when the user wishes to re-engage the worm drive 500 with the rack 41.

Figure 10:
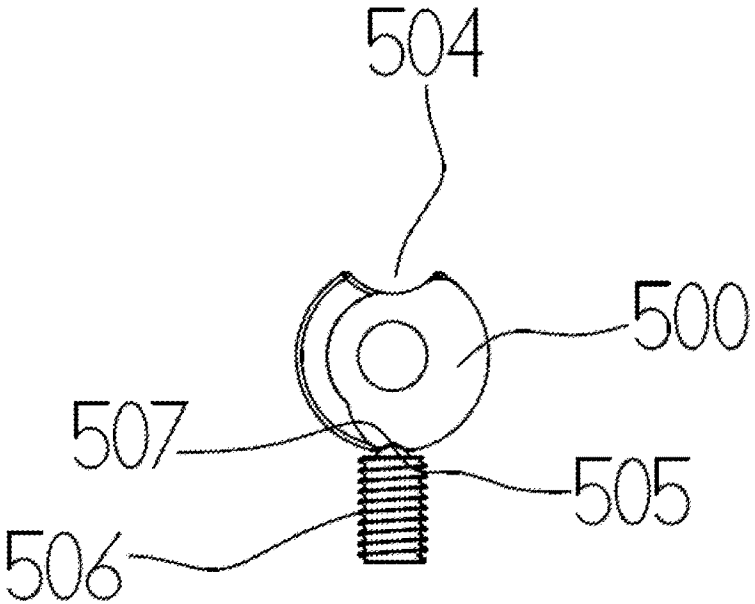
FIG. 10 is an end view the first movable jaw actuator shown FIGS. 6 to 9 and a first movable jaw actuator locator member.

FIG. 10 shows in top view, the worm drive 500 and the spring ball plunger 506 with the detent spring ball 507 engaging in the worm detent profile 505 to locate the worm drive cut-out 504 in its inoperative position.

Figure 11:
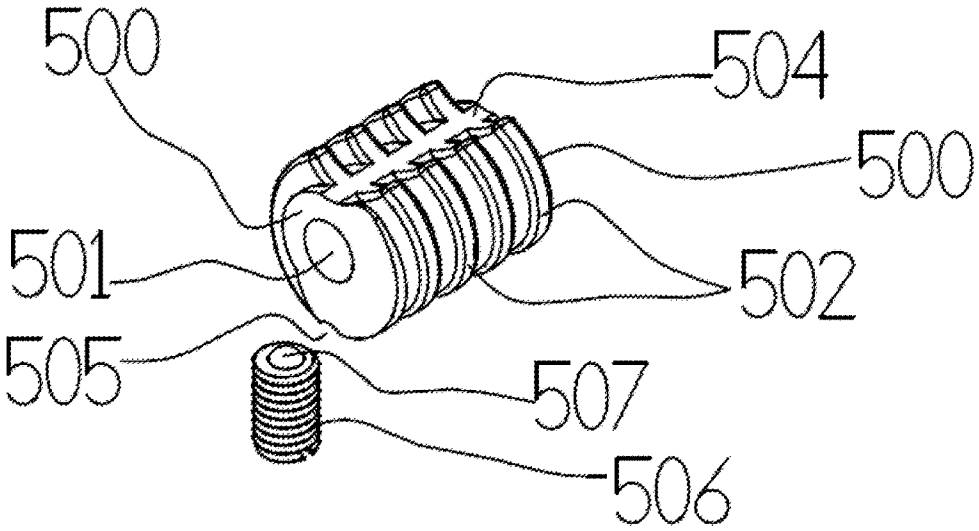
FIG. 11 is a perspective view of first movable jaw actuator and first movable jaw actuator member.

FIG. 11 the said worm drive 500 and the spring ball plunger 506 separate from one another. The detent sprung ball 507 is protruding from the end of the sprung ball plunger 506 profile.

Figure 12:
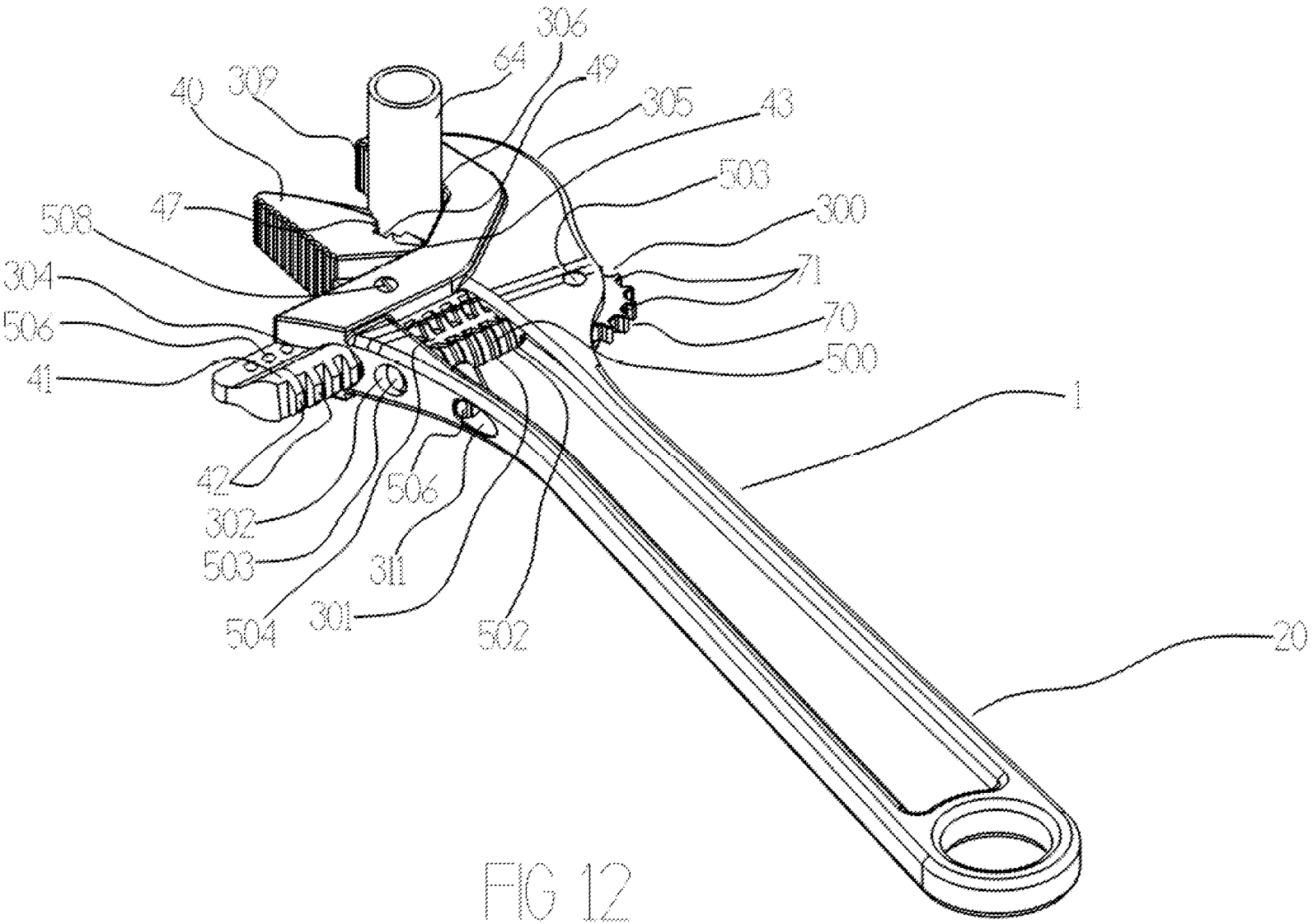
FIG. 12 is a perspective view of the adjustable wrench shown in FIGS. 1 to 3 shown gripping a pipe.
Figure 13:
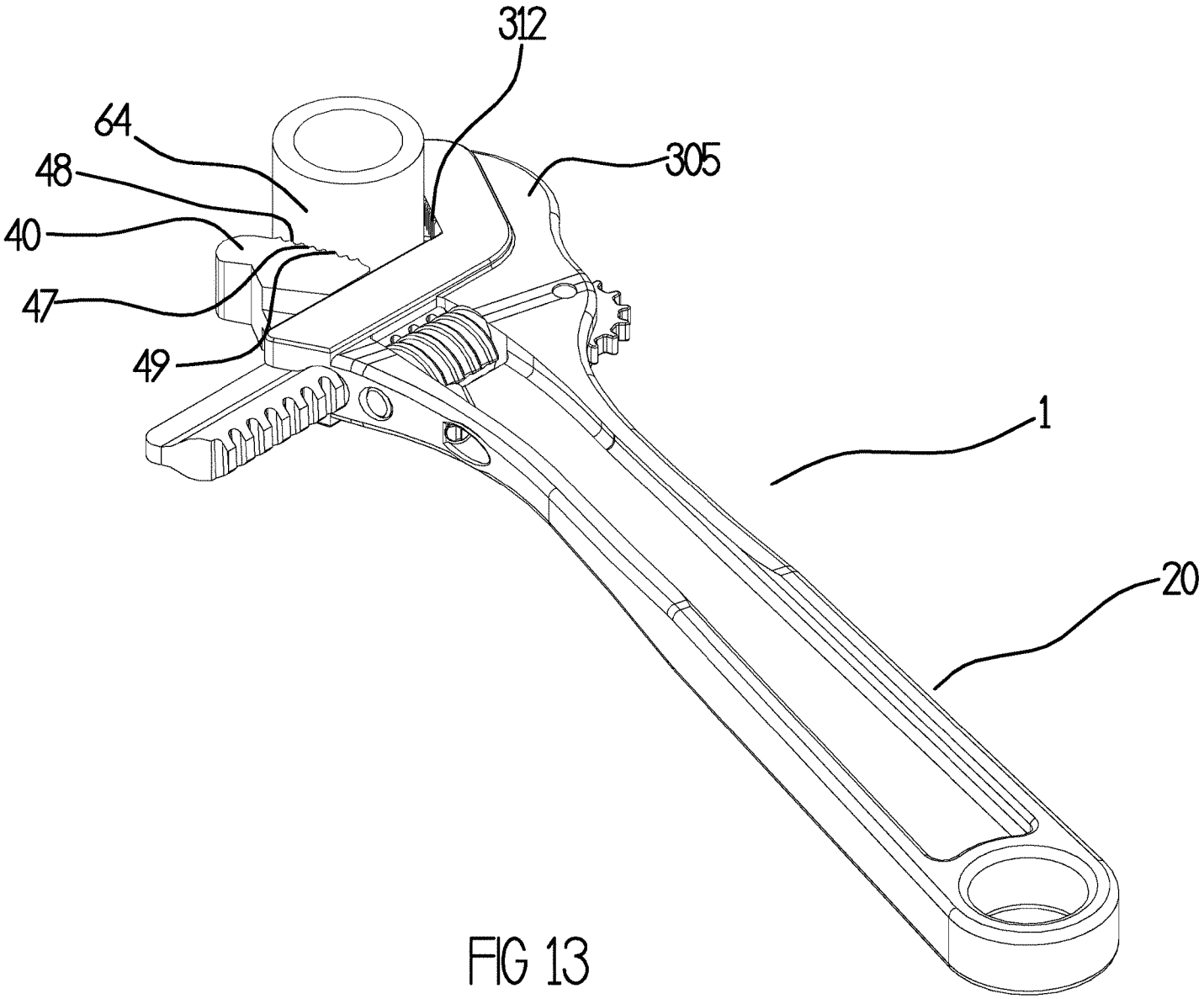
FIG. 13 is a perspective view of the adjustable wrench shown in FIG. 4 shown gripping a pipe FIG. 14 a prior art adjustable wrench.

FIGS. 12 and 13 show the previously described adjustable wrenches 1 gripping differing sizes of tubular workpiece 64 between as shown in FIG. 12 a said generally straight notched 309 fixed jaw second operating face 306 and a toothed V shaped recess 49 incorporating gripping toothed moving jaw fourth 47 and fifth 48 operating faces. The said fixed jaw 305 said second operating face 306 is in this example substantially straight, as an aid to gripping some types of workpieces, the said jaw operating faces 47, 48 and 306 are in best practice toothed or notched 309. In use, in order to employ a simple ratcheting motion upon the surface of the said worked pipework or tube like workpiece 64, the said wrench 1 is near adjusted to the circumferential size upon the said pipe or the like 64, in order to initiate the required grip the said wrench handle 20 is then biased in a side-wards direction whereas the outer angled toothed profiles of the utilized V shaped recess 49 or alternately recesses 49, 312 grip the surface of the said pipe 64 in order to rotate the said pipe 60 in the drive direction. When utilized in the reverse or reposition direction the said handle 20 is usefully returned to a non-biased generally right angled position relative to the said worked pipe 64 whereas the best practice inclined gripping teeth within the said V shaped recess 312, 49 are now profiled in a non-gripping position or direction and the said wrench can be usefully repositioned with ease. The said geared rack 41 said teeth 42 are illustrated engaging the said worm gear 500 said teeth 502, the said worm cut out 504 not utilized.

In the illustrated example, the movable jaw 40 comprises a jaw member and an elongate member. The elongate member as a first side and a second side. The first and second sides are disposed in opposed spaced apart relation. The jaw member projects from the first side and the rack teeth 42 project from the second side. The elongate member is received in the moving jaw receiving slot 304. The first and second movable jaw actuators are rotatable to move the movable jaw towards and away from the fixed jaw. The rotational movement of the first and second movable jaw actuators cause translational movement of the movable jaw on the head portion 300 to vary the size of the jaw opening. The first movable jaw actuator is configured to move the movable jaw by a distance X for each Y degrees of rotation of the first movable jaw actuator and the second movable jaw actuator is configured to move the movable jaw by a distance Z for each Y degrees of rotation of the second movable jaw actuator. The distance X is less than distance Z. Thus, the second movable jaw actuator is able to provide a coarse or rapid movement of the movable jaw, while the first movable jaw actuator is able to provide a fine or slow movement of the movable jaw. Thus, in the illustrated examples, the pitch of the toothing on the worm drive is less than the pitch of the teeth on the thumbwheel.

In the illustrated examples, a first locator formation is provided on the first movable jaw actuator and a first locator member is mounted on the head portion to engage the first locator formation. The first locator member is resiliently biased to engage the first locator formation. In the illustrated examples, the first locator formation is a recess provided in the first movable jaw actuator and the first locater member is a spring-loaded ball. The ball may be carried by a threaded pin that can be screwed into a screw hole provided in the head portion. In other examples, the first locator formation may be a projection and the first locator member may be provided with a recess to receive said projection.

In the illustrated examples, a plurality of second locator formations are provided on the movable jaw and second locator member is mounted on the head portion to engage the second locator formations. The second locator member is resiliently biased to engage the second locator formations. In the illustrated examples, the second locater member is a spring-loaded ball. The ball may be carried by a threaded pin that can be screwed into a screw hole provided in the head portion. The second locator formations comprise a series of recesses disposed in equi-spaced apart relation along the elongate member of the movable jaw. The engagement of the second locator member in successive second locator formations provides a degree of resistance to movement of the movable jaw by the first and second movable jaw actuators. Additionally, the second locator formations are configured such that when the second locator member engages a second locator formation, the toothing of the first movable jaw actuator is aligned with respective spaced defined by adjacent rack teeth. This makes it easy for a use to position the movable head relative to the first movable jaw actuator to allow the toothing of the first movable jaw actuator to be rotated smoothly into engagement with the rack teeth when the first movable jaw member is rotated to an operative position.

FIG. 13 is a perspective view of the dual jaw adjustable wrench 1. The said wrench 1 shown gripping a large tubular workpiece 64 between a said fixed jaw 305, V shaped 312 recess said second and third operating faces 306, 307 and a gripping toothed, angled moving jaw 40 fourth operating face 47.

Figure 14:
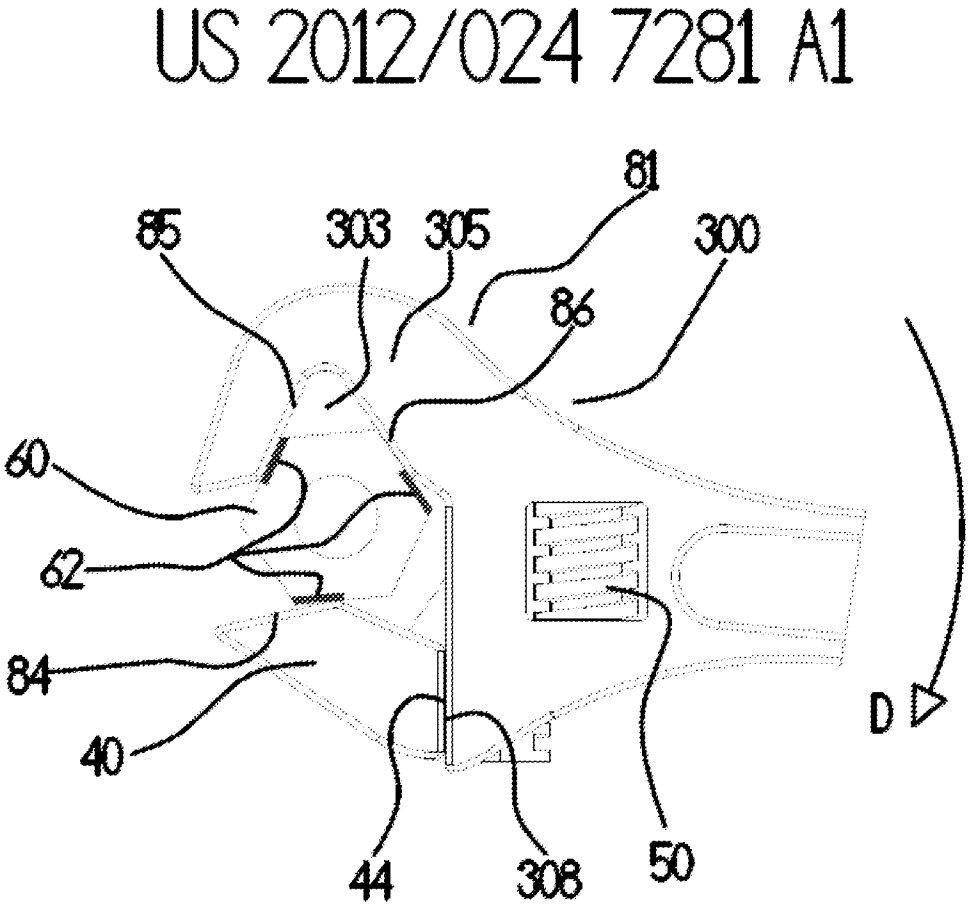
Figure 15:
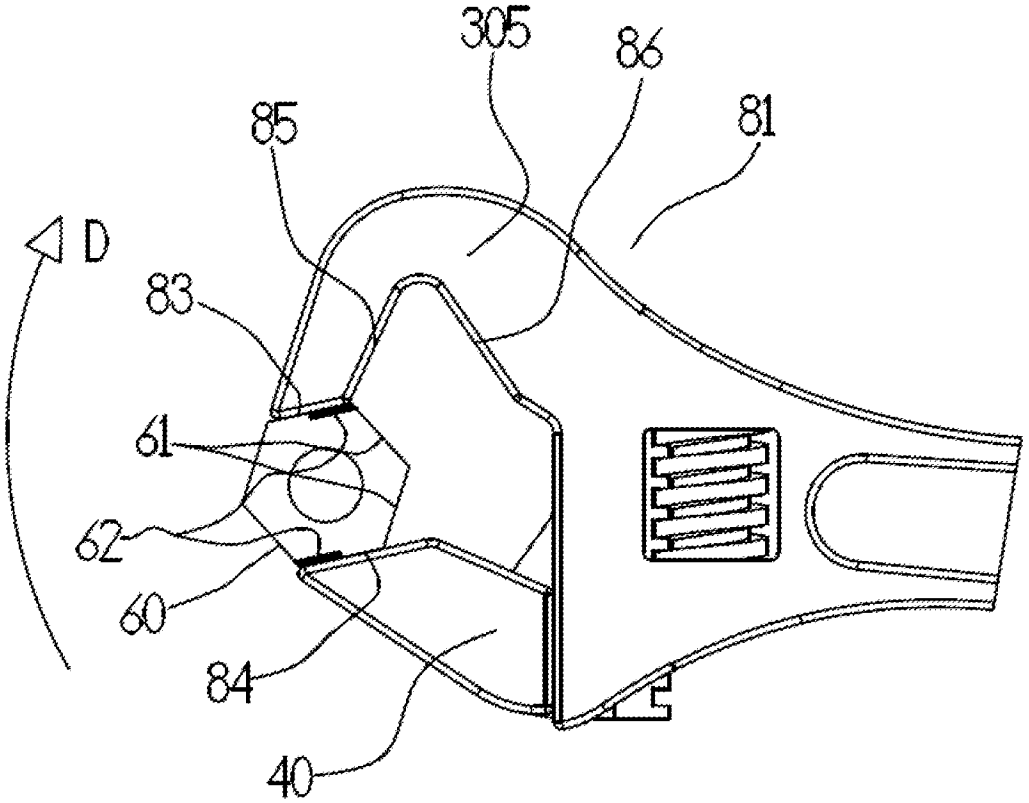
FIG. 15 shows a second prior art adjustable wrench.

FIGS. 14 and 15 denote a prior art device 81 according to US application 2012/0247281 A1. FIG. 14 shows the said device head portion 300 wherein three operating faces 84, 85 and 86 are utilized. The moving jaw 40 is prevented from accessing the V shaped recess 303 within the fixed jaw portion 305 by the obstruction of the fourth operating face 84, the said moving and fixed jaws 40, 305 remaining parallel to the said worm drive 500 and said sliding rails 44, 308. The resulting geometry of the said operating faces 84, 85 and 86 giving only partial grip of the required fastener driven faces 62 when the said wrench is utilized in the said drive direction D, even if the said sprung ratcheting operating face 84 were to become fixed, the said fastener 60 grip imparted being little more than that of a conventional adjustable wrench while the manufacturing cost is invariably higher.

FIG. 15 shows the said device 81's first and second operating faces 83, 84's problematic grip upon the said driven faces 62 of said smaller fastener 60 sizes. The smaller said fasteners 60 are unable to be operated by the optimal said third and fourth operating faces 85, 86.

Figure 16:
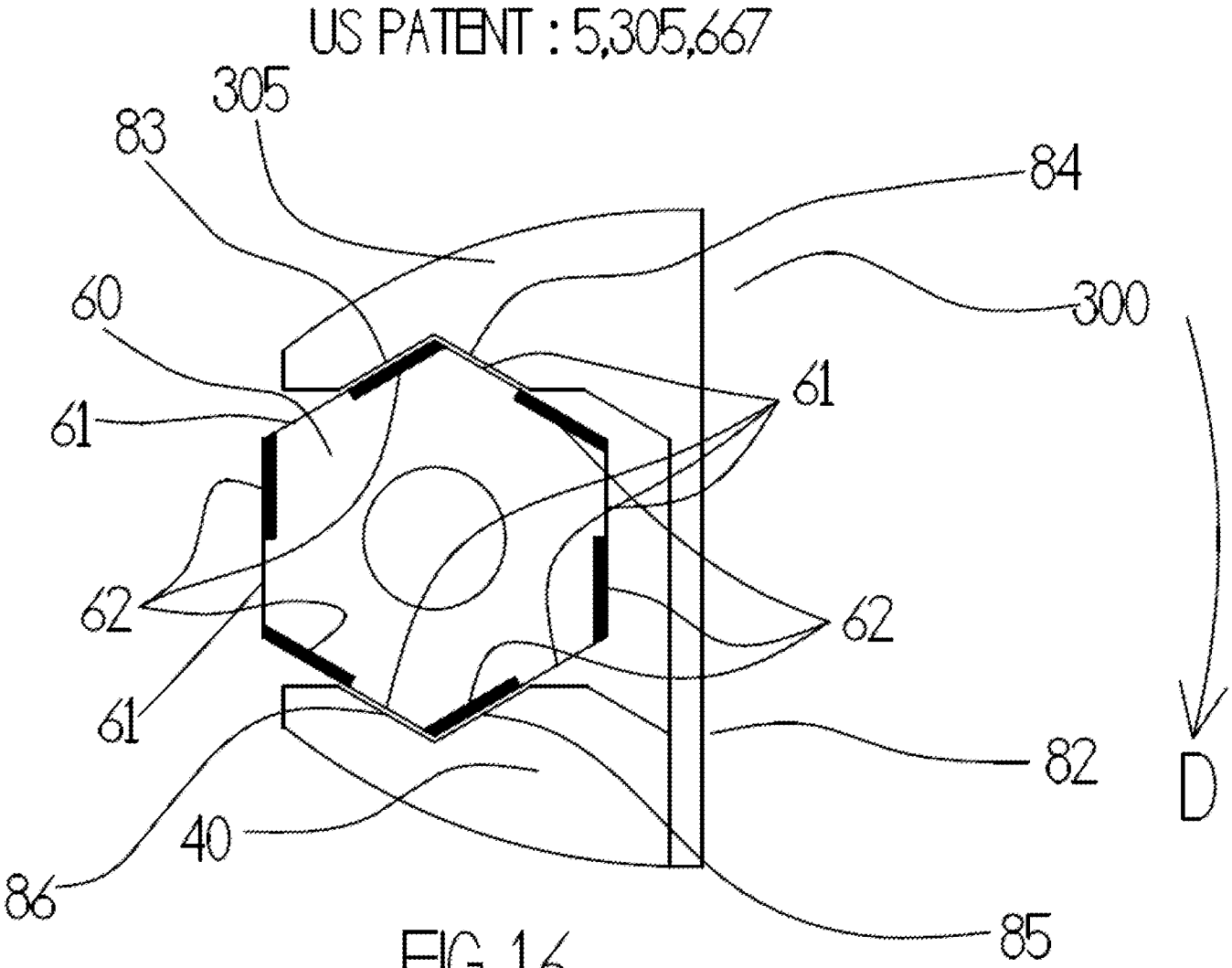
FIG. 16 shows a third prior art adjustable wrench.

FIG. 16 denotes the head portion 300, with moving and fixed jaws 40, 305 of a prior art device 82, according to U.S. Pat. No. 5,305,667, the hexagonal fastener 60 displayed is gripped by four said operating faces 83, 84, 85 and 86. Although giving the appearance of a superior four said operating face 83, 84, 85 and 86 operating grip upon the said fastener faces 61, when the said device 82 as shown in FIG. 16 is utilized in the illustrated drive direction D the only functional actuation of the fastener driven portions 62 and thereby any required robust operation of the fastener 60, is limited to said operating faces 83, 85 as only these said faces 83, 85 can actually usefully drive against the fastener drive portions 62 with any useful toque in the illustrated drive direction D. If the device 82 were utilized in the opposite to the displayed drive direction D, only the said faces 84, 86 would act on the worthwhile fastener drive portions 62 as the fastener drive portions 62 would now be changed to the opposite end of the fastener drive faces 61.

FIG. 17 illustrates a budget iteration of the said wrench 1, the said fixed jaw 305 said second operating face 306 in the example shown is substantially straight and the said first operating face 43 is also straight and the said jaw opening 310 is generally parallel, there is no said thumbwheel 70 required. In order to adjust between majorly different sizes the operator aligns the said worm gear 50, cut-out 54 with the said geared rack 41, teeth 42, grips the said handle 20 and the said moving jaw 40 and simply propels as required the moving jaw 40 inwards or outwards from the fixed jaw 305. The optional known moving jaw sprung plunger 508 and associated detent recesses 509 or the like can be further replaced with a known friction restriction device or a known pin or in best practice a sprung plate 510. The said thin sprung blade 510 is located by the worm gear axle pin 503 through its locating hole 512 and prevented from axial movement between the said worm gear 500 and the wall of the worm gear aperture 301, a further spacer 513 can be usefully employed in order to allow adequate resilient movement of the said sprung blade 510 during the re-positioning of the said moving jaw 40. When the operator has near adjusted the said moving jaw 40 and requires to re-engage the said worm gear 500 into the said geared rack teeth 42 the said sprung blade 510 said engagement portion further provides a method whereby the said moving jaw geared rack teeth 42 can be usefully resiliently retained in the appropriate location prior to the re-engagement of the said worm gear teeth 502 into the said geared rack teeth 42 prior to the re-engagement of the said worm gear teeth 502 into the said geared rack teeth 42 during the final adjustment process. The said engagement portion 511 being capable of usefully flexing in order to allow the moving jaw 40 to be robustly propelled as required inwards or outwards within the said moving jaw receiving slot 304 during the fast adjustment action, yet usefully retaining the said moving jaw 40 within the said receiving slot 304 when the said worm gear 500 is disengaged.

The invention claimed is:

1. An adjustable wrench comprising:

a wrench head provided with a fixed jaw;

a movable jaw carried by said wrench head;

a first movable jaw actuator mounted on said wrench head; and a second movable jaw actuator mounted on said wrench head, wherein said first and second movable jaw actuators are rotatable about respective axes of rotation, said first movable jaw actuator is configured to move said movable jaw by a distance X for each Y degrees of rotation of said first movable jaw actuator, said second movable jaw actuator is configured to move said movable jaw by a distance Z for each Y degrees of rotation of said second movable jaw actuator and said distance Xis less than said distance Z, and wherein said movable jaw is provided with teeth engagable by said first and second movable jaw actuators and said first movable jaw actuator is movable to an inoperative position in which said first movable jaw actuator is disengaged from said teeth to enable actuation of said movable jaw by said second movable jaw actuator.

2. An adjustable wrench as claimed in claim 1, wherein said movable jaw comprises a jaw member and an elongate member that has a first side and a second side that is disposed in opposed spaced apart relation to said first side, said elongate member is received in a slot provided in said wrench head, said jaw member projects from said first side and said teeth project from said second side.

3. An adjustable wrench as claimed in claim 1, wherein said axes of rotation are mutually perpendicular.

4. An adjustable wrench as claimed in claim 1, wherein:

said first movable jaw actuator comprises a body having a longitudinal axis that defines said axis of rotation of said first movable jaw actuator;

said body is provided with toothing that winds about said axis of rotation and is engagable with said teeth and a gap in said toothing; and said first movable jaw actuator is rotatable to a position in which said gap faces said teeth to define said inoperative position of said first movable jaw actuator.

5. An adjustable wrench as claimed in claim 4, wherein said body is housed in an aperture defined in said wrench head and protrudes from at least one major face of said wrench head to permit a user to cause said rotation of said body.

6. An adjustable wrench as claimed in claim 4, further comprising a first movable jaw actuator locator member configured to engage a first locator formation provided on said first movable jaw actuator to locate said body in said position in which said gap faces said teeth.

7. An adjustable wrench as claimed in claim 6, wherein said first movable jaw actuator locator member comprises a resiliently biased member mounted on said wrench head.

8. An adjustable wrench as claimed in claim 4, wherein said movable jaw is provided with a plurality of spaced apart second locator formations engageable by a resiliently biased second locator member mounted on said wrench head, said second locator formations being configured such that when said second locator member is engaged with a said second locator formation, said toothing of said first movable jaw actuator is aligned with respective spaces defined by adjacent said teeth of said movable jaw.

9. An adjustable wrench as claimed claim 1, wherein said second movable jaw actuator comprises a disc having a circumferentially extending periphery and a plurality of teeth disposed in equi-spaced apart relation about said periphery.

10. An adjustable wrench as claimed claim 1, wherein said fixed jaw has a side that defines two mutually inclined workpiece gripping faces.

11. An adjustable wrench as claimed in claim 1, wherein said movable jaw has a first side that defines at least one workpiece gripping face.

12. An adjustable wrench as claimed in claim 11, wherein said workpiece gripping faces are arranged to grip respective faces of a polygonal workpiece so that, in use, each workpiece gripping face can apply a drive torque to the respective face of the polygonal workpiece.

13. An adjustable wrench as claimed in claim 11, wherein said movable jaw has a second side that faces away from said first side and defines at least one further workpiece gripping face.

14. A method of operating an adjustable wrench, wherein said adjustable wrench comprises a wrench head having a fixed jaw, a movable jaw, a first movable jaw actuator and a second movable jaw actuator, wherein said movable jaw comprises a plurality of teeth engaged by said first and second movable jaw actuators, wherein said first and second movable jaw actuators are rotatable about respective axes of rotation, said first movable jaw actuator is configured to move said movable jaw by a distance X for each Y degrees of rotation of said first movable jaw actuator, said second movable jaw actuator is configured to move said movable jaw by a distance Z for each Y degrees of rotation of said second movable jaw actuator and said distance X is less than said distance Z, and wherein said method comprises rotating said first movable jaw actuator to a position in which said first movable jaw actuator is disengaged from said teeth and moving said movable jaw by rotating said second movable jaw actuator.

15. A method as claimed in claim 14, wherein said first movable jaw actuator is provided with spiralling toothing engagable with said teeth and a cut-out defining a gap in said spiralling toothing and said first movable jaw actuator is disengaged from said teeth by rotating said first movable jaw actuator to a position in which said gap faces said teeth.

16. A method as claimed in claim 15, wherein said first movable jaw actuator is provided with a first locator formation and said wrench head is provided with a resiliently biased first locator member, and said method further comprises rotating said first movable jaw actuator to a position in which said first locator member engages said first locator formation to bring said first movable jaw actuator to said position in which said gap faces said teeth.

17. A method as claimed in claim 15, wherein said movable jaw is provided with a plurality of second locator formations and a resiliently biased second locator member is mounted on said wrench head, and the method further comprises engaging said second locator member with a said second locator formation to align said spiralling toothing with respective spaces defined between adjacent said teeth to permit engagement of said toothing and teeth by rotation of said first movable actuator to move said toothing into said spaces.

* * * * *